US006019357A

United States Patent [19]

Bartsch et al.

[11] Patent Number: 6,019,357

[45] Date of Patent: Feb. 1, 2000

[54] UNIFORCE HYDRAULIC CLAMP

[75] Inventors: Harold Bartsch; Gary Stoltz, both of Owatonna, Minn.

[73] Assignee: SPX Corporation, Muskegon, Mich.

[21] Appl. No.: 09/197,905

[22] Filed: Nov. 23, 1998

[51] Int. Cl.[7] ..... B25B 1/20

[52] U.S. Cl. ..... 269/43; 269/34; 269/32

[58] Field of Search ..... 269/43, 906, 234, 269/157, 32, 13

[56] References Cited

U.S. PATENT DOCUMENTS

| | | | |
|---|---|---|---|
| 2,850,926 | 9/1958 | Jobe | 269/34 |
| 5,039,074 | 8/1991 | Klancnik et al. | 269/34 |
| 5,201,501 | 4/1993 | Fassler | 269/32 |
| 5,718,420 | 2/1998 | Bernstein | 269/157 |

FOREIGN PATENT DOCUMENTS

| | | | |
|---|---|---|---|
| 2913506 | 10/1980 | Germany | 269/32 |
| 0984798 | 1/1983 | U.S.S.R. | 269/34 |
| 1125118 | 11/1984 | U.S.S.R. | 269/32 |

OTHER PUBLICATIONS

Tiny Vise, double edge clamp article by Carr Lane Manufacturing Co., article Jan. 1998.

Tiny Vise, edge clamps, Carr Lane Manufacturing Co., article Jan. 1998.

MiniLock Product Line, Kurt Manufacturing Company, article Jan. 1998.

*Primary Examiner*—David A. Scherbel
*Assistant Examiner*—Daniel G. Shanley
*Attorney, Agent, or Firm*—Hovey, Williams, Timmons & Collins

[57] ABSTRACT

A preferred clamping apparatus includes an hydraulic pull cylinder having a piston rod connected to the shaft of a wedge-shaped clamp operator received in a complementally shaped opening defined in a clamp block having a shiftable jaw. In operation, retraction of the piston rod pulls the operator toward the base of the block in order to shift the jaw to a clamping position to hold a workpiece. In preferred forms, the clamping apparatus is included as part of a fixture and operable to clamp a workpiece to the fixture.

18 Claims, 1 Drawing Sheet

UNIFORCE HYDRAULIC CLAMP

RELATED APPLICATIONS

Not applicable.

FEDERALLY SPONSORED RESEARCH OR DEVELOPMENT

Not applicable.

MICROFICHE APPENDIX

Not applicable.

BACKGROUND OF THE INVENTION

1. Field of the Invention

The present invention relates to the field of hydraulically operated clamps. In particular, the invention is concerned with an hydraulic pull cylinder having a piston rod connected to the shaft of a wedge-shaped clamp operator received in a complementally shaped opening defined in a clamp block having a shiftable jaw. Retraction of the piston rod pulls the operator toward the base of the block in order to shift the jaw to a clamping position to hold a workpiece.

2. Description of the Prior Art

In the prior art, manually operated clamps are used to hold workpieces during machining and other manufacturing operations. These prior art clamps include a clamp block positioned on a support plate. The block includes a shiftable jaw. A bolt with a wedge-shaped head is received into a recess in the block and extends through the block into a threaded hole in the support plate. An alien wrench or the like is used to tighten the bolt into the hole. The bolt head spreads the block in order to extend the jaw and pin a workpiece against a support wall. When operations on the workpiece are completed, the wrench is used to reverse the bolt and release the workpiece from the clamp.

These prior art manually operated clamps are time-consuming and tedious to use on a repetitive basis. As a result, manufacturing productivity is less than optimum.

SUMMARY OF THE INVENTION

The present invention solves the prior art problems discussed above and provides a distinct advance in the state of the art. In particular, the clamping apparatus hereof allows for rapid clamping and release of workpieces with minimal manual effort.

The preferred clamping apparatus of the present invention includes a clamp and a power cylinder. The clamp includes a clamping block with a shiftable jaw and a clamp operator presenting a generally wedge-shaped configuration shiftably received in a complementally configured opening defined in the block. Shifting of the operator in the opening shifts the jaw between retracted and clamping positions. The power cylinder includes a piston rod coupled with the operator. Actuation of the cylinder shifts the rod and the clamp operator and thereby shifts the jaw between retracted and clamping positions.

In preferred forms of the invention, the cylinder is a pull-down hydraulic cylinder positioned below the clamp block with the piston rod spring-biased toward the extended position. The clamp block is resilient and biases the jaw toward the retracted position. Actuation of the cylinder pulls the clamp operator further into the recess to spread the block and thereby extend the jaw to the clamping position. Upon release of hydraulic fluid from the cylinder, the piston rod extends and the jaw shifts toward the retracted position. Other preferred aspects of the present invention are disclosed herein.

DETAILED DESCRIPTION OF THE PREFERRED EMBODIMENT

Figure 2:
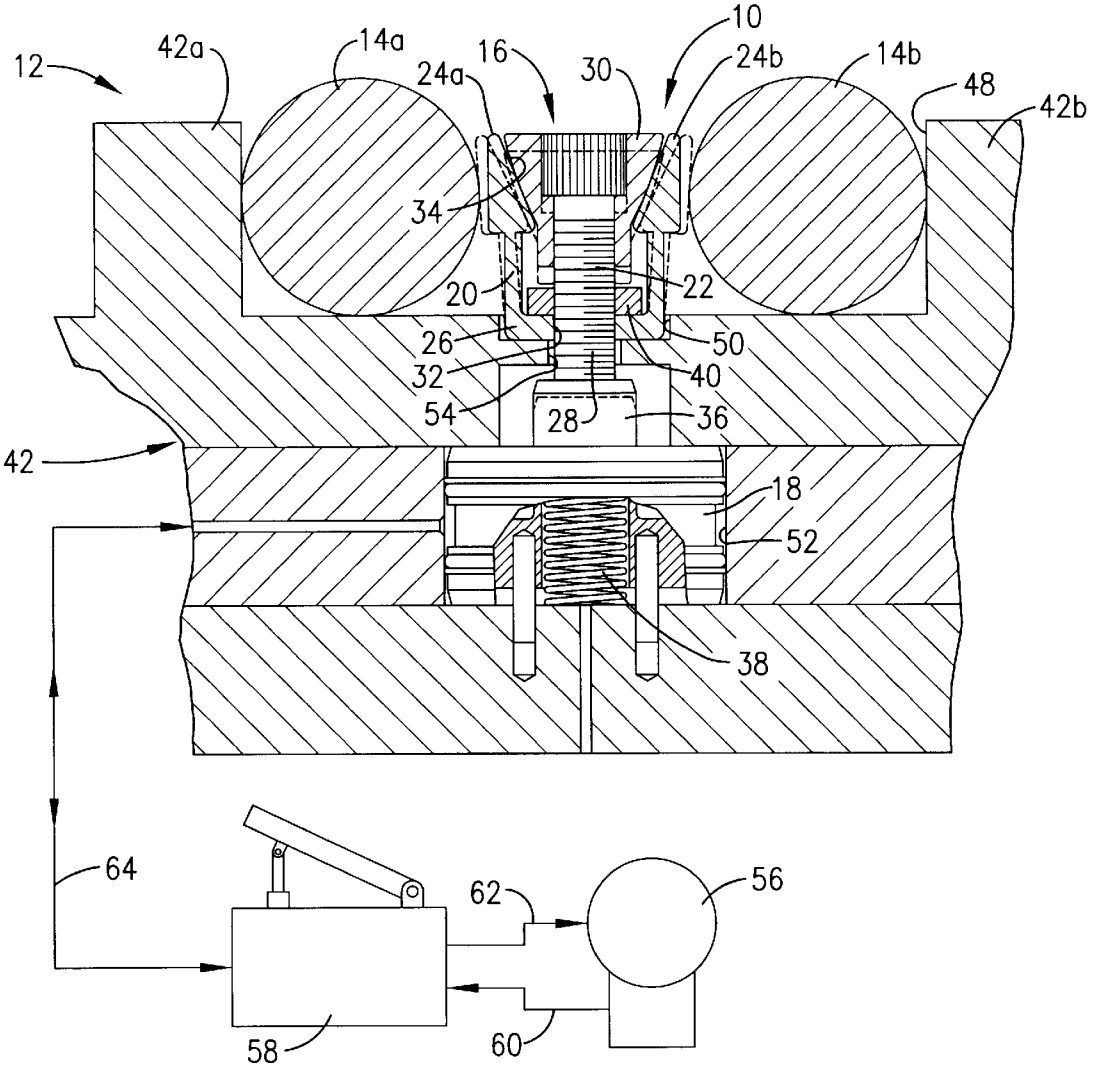
FIG. 2 is a sectional view of the clamping apparatus of FIG. 1 shown in use as part of a fixture receiving a workpiece with the hydraulic system shown as a schematic diagram.

The drawing figures illustrate clamp apparatus 10 in accordance with the present invention. FIG. 2 illustrates apparatus 10 incorporated as part of a fixture 12 for holding a workpiece such as workpieces 14*a* and 14*b*, also in accordance with the present invention. Apparatus 10 includes clamp 16 and power cylinder 18.

Clamp 16 includes clamp block 20 and clamp operator 22. The drawing figures illustrate clamp 16 in the nature of a clamp such as an OK-VISE clamp available from Mitee-Bite Products Company. Other types and styles of clamps are also suitable for use in the present invention such as a TINY VISE double or single edge clamp available from Carr Lane Manufacturing Company, and a MiniLock clamp available from Kurt Manufacturing, among others.

Figure 1:
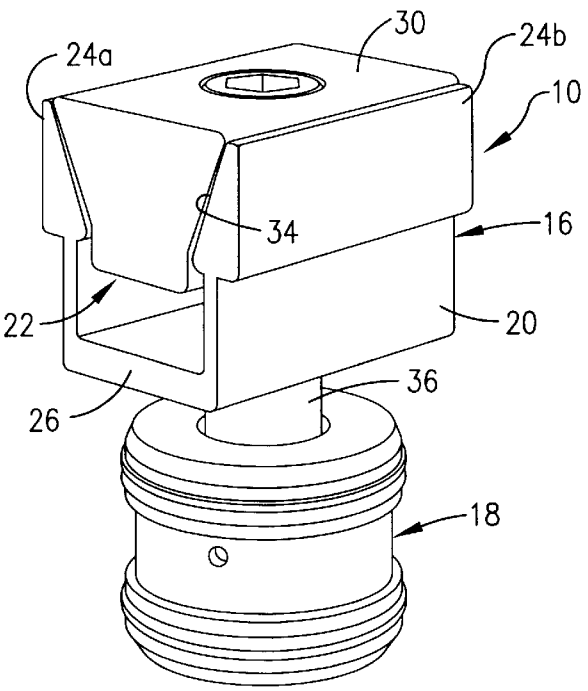
FIG. 1 is a pictorial view of the preferred clamping apparatus in accordance with the present invention.

Aluminum block 20 presents a generally U-shaped configuration and includes two spreadable arms as clamping jaws 24*a* and 24*b* interconnected by base 26. Jaws 24*a,b* are shiftable between a retracted position shown in FIGS. 1 and 2 and an extended, clamping position illustrated by the phantom lines in FIG. 2. The resilient nature of block 20 biases jaws 24*a,b* toward the retracted position.

Clamp operator 22 is in the nature of an allen bolt having threaded shaft 28 extending therefrom with the head end of the bolt enclosed by wedge-shaped body 30 composed of resilient material. Shaft 28 extends through hole 32 defined in base 26. Wedge-shaped body 30 is received in a complementally shaped opening 34 defined in block 20. Specifically, the inboard surfaces of jaws 24*a,b* are configured to receive and engage the walls of body 30 as illustrated in the drawing figures. The upper surface of clamp operator 22 is flush with the upper surface of clamp block 20 when jaws 24*a,b* are in the retracted position as illustrated in FIG. 2.

Power cylinder 18 is preferably a pull-down hydraulic cylinder although air operated cylinders could be used in selected applications. Cylinder 18 includes piston rod 36 extending therefrom with spring 38 biasing rod 36 toward the extended position shown in FIG. 2. Phantom lines illustrate the retracted position.

Preferred apparatus 10 also includes ring-shaped stop 40, preferably made of aluminum, encircling shaft 28 and positioned between resilient body 30 and base 26. Stop 40 limits the downward movement of operator 22 in order to prevent spreading of jaws 24*a,b* beyond their structural limits.

Turning to FIG. 2, fixture 12 includes fixture base 42 having spaced, support walls 44*a* and 44*b* extending upwardly therefrom defining workpiece area 48 therebetween. Recess 50 is defined in fixture base 42 midway between walls 44*a,b* with support base 26 of clamp block 20 received and supported therein. Fixture base 42 also includes compartment 52 receiving and supporting cylinder 18 therein directly below clamp 16. Clamp operator shaft 28 extends through aperture 54 defined in fixture base 42. The lower end of shaft 28 is threadably coupled into the upper end of piston rod 36.

Conventional hydraulic components are used to operate cylinder 18. These components include conventional hydraulic source 56 connected to a foot-operated or hand-operated actuator 58 by way of supply line 60 and return line 62. Hydraulic line 64 interconnects actuator 58 and cylinder 18 through a connection extending through fixture base 42 as illustrated.

In use, cylinder 18 is initially not under hydraulic pressure. As a result, spring 38 pushes piston rod 36 upwardly to the extended position as illustrated in FIG. 2. With rod 36 extended, clamp operator 22 is also extended and jaws 24*a,b* are in the retracted position.

Workpieces 14*a,b* are placed on either or both sides of clamp 16 adjacent respective support walls 44*a,b*. Actuator 58 is then operated in order to supply pressurized hydraulic fluid from hydraulic source 56 by way of supply line 60, through actuator 58 and through hydraulic line 64 to cylinder 18. This pushes piston rod 36 downwardly as viewed in FIG. 2 and shifts clamp operator 22 further into opening 34. The wedge-shaped configuration of body 30 spreads jaws 24*a,b* until they engage and hold respective workpieces 14*a,b* in the clamping position.

Changing the position of actuator 58 releases hydraulic fluid from cylinder 18 allowing the fluid to return by way of lines 64 and 62 to source 56. This allows spring 38 to shift piston rod 36 and clamp operator 22 upwardly. Jaws 24*a,b* return to the retracted position and release workpieces 14*a,b* for removal.

In the event actuator 58 is operated in the absence of workpieces, or the workpieces are too small, clamp operator 22 shifts downwardly until the lower surface of wedge-shaped body 30 engages stop 40. Stop 40 is positioned and sized to stop movement of clamp operator 22 before jaws 28*a,b* are spread beyond their structural limits. Normally the size of the workpiece is sufficient to prevent such an occurrence.

Those skilled in the art will appreciate that the present invention encompasses many variations in the preferred embodiment described herein. In addition to a variety of styles and types of clamps, the invention also encompasses other variations in the preferred fixture including those allowing the clamping of a single workpiece and other orientations of the components of the clamping apparatus. Having thus described the preferred embodiment, the following is claimed as new and desired to be secured by Letters Patent:

We claim:

1. A clamp apparatus comprising:

a clamp including a clamp block presenting an integral and generally U-shaped configuration having spreadable, opposed arms interconnected by a base to define a clamping jaw shiftable between a retracted position and an extended, clamping position, and a clamp operator presenting a generally wedge-shaped body received in a complimentary configured opening defined in said block between the opposed arms; and a power cylinder including a selectively shiftable piston rod extending therefrom and coupled with said operator in order to shift said operator and thereby shift said jaw between said positions.

2. The apparatus of claim 1, said clamp body being composed of aluminum, said clamp operator being composed of resilient material.

3. The apparatus of claim 1, said operator including a shaft extending through said block and presenting a distal end, said piston rod being axially coupled with said distal end.

4. The apparatus of claim 2, said cylinder being operable to retract said piston rod upon application of pressurized fluid to said cylinder in order to shift said operator further into said opening and thereby shift said jaw to said clamping position.

5. The apparatus of claim 4, said block including a base, said apparatus further including a stop positioned between said clamp operator and said base, said stop being configured to limit the shifting of said clamp operator toward said base.

6. The apparatus of claim 5, said stop presenting a ring-shaped configuration surrounding said shaft.

7. The apparatus of claim 4, said jaw being resilient and biased toward said released position, said cylinder being operable to retract said piston rod toward a retracted position upon application of pressurized fluid thereto in order to shift said jaw toward said clamping position, said cylinder including a spring biasing said piston rod toward an extended position opposite said retracted position.

8. The apparatus of claim 7, said clamp further including a stop positioned between said clamp operator and said base, said stop being configured to limit the shifting of said clamp operator toward said base, said stop presenting a ring-shaped configuration surrounding said shaft.

9. The apparatus of claim 8, said cylinder being an hydraulic cylinder.

10. A workpiece holding assembly comprising:

a fixture configured to receive a workpiece; and a clamp apparatus including a clamp block supported by said fixture and presenting a generally U-shaped configuration with opposed arms integrally interconnected by a base to form a clamping jaw shiftable between a retracted position and an extended, clamping position, said jaw being located for clamping a workpiece received by said fixture when in said clamping position, a clamp operator presenting a generally wedge-shaped configuration received in a complimentary configured opening defined in said block, said jaw being shiftable between said positions upon shifting of said operator in said opening, and a power cylinder supported by said fixture including a selectively shiftable piston rod extending therefrom and coupled with said operator in order to shift said operator and thereby shift said jaw between said positions.

11. The apparatus of claim 9, said clamp body being composed of aluminum, said clamp operator being composed of resilient material.

12. The apparatus of claim 10, said operator including a shaft extending through said block and presenting a distal end, said piston rod being axially coupled with said distal end.

13. The apparatus of claim 12, said cylinder being operable to retract said piston rod upon application of pressurized fluid to said cylinder in order to shift said operator further into said opening and thereby shift said jaw to said clamping position.

14. The apparatus of claim 13, said block including a base, said apparatus further including a stop positioned between said clamp operator and said base, said stop being configured to limit the shifting of said clamp operator toward said base.

15. The apparatus of claim 14, said stop presenting a ring-shaped configuration surrounding said shaft.

16. The apparatus of claim 13, said jaw being resilient and biased toward said released position, said cylinder being operable to retract said piston rod toward a retracted position upon application of pressurized fluid thereto in order to shift said jaw toward said clamping position, said cylinder including a spring biasing said piston rod toward an extended position opposite said retracted position.

17. The apparatus of claim 16, said clamp further including a stop positioned between said clamp operator and said base, said stop being configured to limit the shifting of said clamp operator toward said base, said stop presenting a ring-shaped configuration surrounding said shaft.

18. The apparatus of claim 17, said cylinder being an hydraulic cylinder.

* * * * *